United States Patent [19]

Peterson

[11] 4,308,517

[45] Dec. 29, 1981

[54] HEAT SENSING APPARATUS

[75] Inventor: Reuben E. Peterson, Fergus Falls, Minn.

[73] Assignee: Jenoff, Incorporated, Fergus Falls, Minn.

[21] Appl. No.: 212,545

[22] Filed: Dec. 3, 1980

[51] Int. Cl.[3] ..... H01H 37/04

[52] U.S. Cl. ..... 337/372; 310/68 C

[58] Field of Search ..... 335/372, 373, 374, 375, 335/376, 377, 378, 379, 380; 310/68 C

[56] References Cited

U.S. PATENT DOCUMENTS

| | | | |
|---|---|---|---|
| 2,357,533 | 9/1944 | Meza | 337/372 X |
| 3,875,439 | 4/1975 | Roach | 310/68 C |
| 4,045,761 | 8/1977 | Peterson | 337/372 |

*Primary Examiner*—George Harris

*Attorney, Agent, or Firm*—Zarley, McKee, Thomte, Voorhees & Sease

[57] ABSTRACT

A heat sensing apparatus for a member requiring heat monitoring such as bearings, etc. is described. A heat conductive plate is secured to the lower end of a hollow cartridge and closes the open bottom of the cartridge. A heat sensing device is mounted on the heat conductive plate within the cartridge and has a pair of electrical wires secured thereto which extend outwardly through one end of the cartridge. A bushing is secured to one end of the bushing and has a nipple threadably mounted thereon. One end of a flexible conduit has a nut mounted thereon which is threadably secured to the nipple to provide a rodent and dust proof connection between the flexible conduit and the bushing mounted on the cartridge. An epoxy material is contained within the cartridge and at least a portion of the bushing to seal the interior of the cartridge and to protect the heat sensing device. The cartridge is secured to the member requiring heat monitoring by small nails or the like extending through the plate so that heat from the member will be transmitted through the plate to the heat sensing device. The heat sensing device is operatively connected by the electrical wires to a signal device.

3 Claims, 8 Drawing Figures

110V

HEAT SENSING APPARATUS

BACKGROUND OF THE INVENTION

This invention relates to a heat sensing apparatus and more particularly to a heat sensing apparatus for use in combination with bearings, electrical motors, etc.

Applicant previously devised a mounting bracket for a heat detector switch and received U.S. Pat. No. 4,045,761 on Aug. 30, 1977. Although the heat detector switch and mounting bracket described in Pat. No. 4,045,761 has been quite successful, some problems have been experienced with the previous device in that rodents sometime damage the electrical wires extending from the device.

As noted in applicant's previous patent, heat detectors have been employed on bearings, motors, etc. to provide a warning if and when the motor or bearing becomes overheated. Heat detectors are generally shown in U.S. Pat. Nos. 2,119,184; 2,164,674; 2,596,847 and 2,709,210. Although the devices of the prior art may have been generally satisfactory, the devices were difficult to mount on the associated structure and required extensive modification thereof. Additionally, the devices disclosed in the prior art are subject to damage upon being struck by a tool, broom, etc. Applicant's previous patent did provide a significant advance in the prior art and the instant invention is regarded as being a significant improvement over applicant's earlier design.

Therefore, it is a principal object of the invention to provide an improved heat sensing apparatus for members requiring heat monitoring such as motors, bearings, etc.

A further object of the invention is to provide a heat sensing apparatus which is rodent proof.

A still further object of the invention is to provide a heat sensing apparatus for bearings, motors, etc. which is ideally suited for use with hollow flexible conduit.

A still further object of the invention is to provide a heat sensing apparatus which is economical to manufacture, durable in use and refined in appearance.

BRIEF DESCRIPTION OF THE DRAWINGS

FIG. 1 is a perspective view illustrating the heat sensing apparatus of this invention mounted on a bearing:

FIG. 2 is a partial sectional view of the apparatus illustrating the manner in which the pourable epoxy is positioned in the cartridge:

FIG. 3 is a side elevational view of the apparatus mounted on a bearing or the like:

FIG. 4 is a partial exploded perspective view of the apparatus:

FIG. 5 is a sectional view as seen on lines 5—5 of FIG. 4:

FIG. 6 is an enlarged sectional view seen on lines 6—6 of FIG. 5:

FIG. 7 is a sectional view seen on lines 7—7 of FIG. 6; and

FIG. 8 is a typical schematic of the circuitry of the device.

SUMMARY OF THE INVENTION

Figures 1, 2, 3, 4, 5, 6, 7, 8:
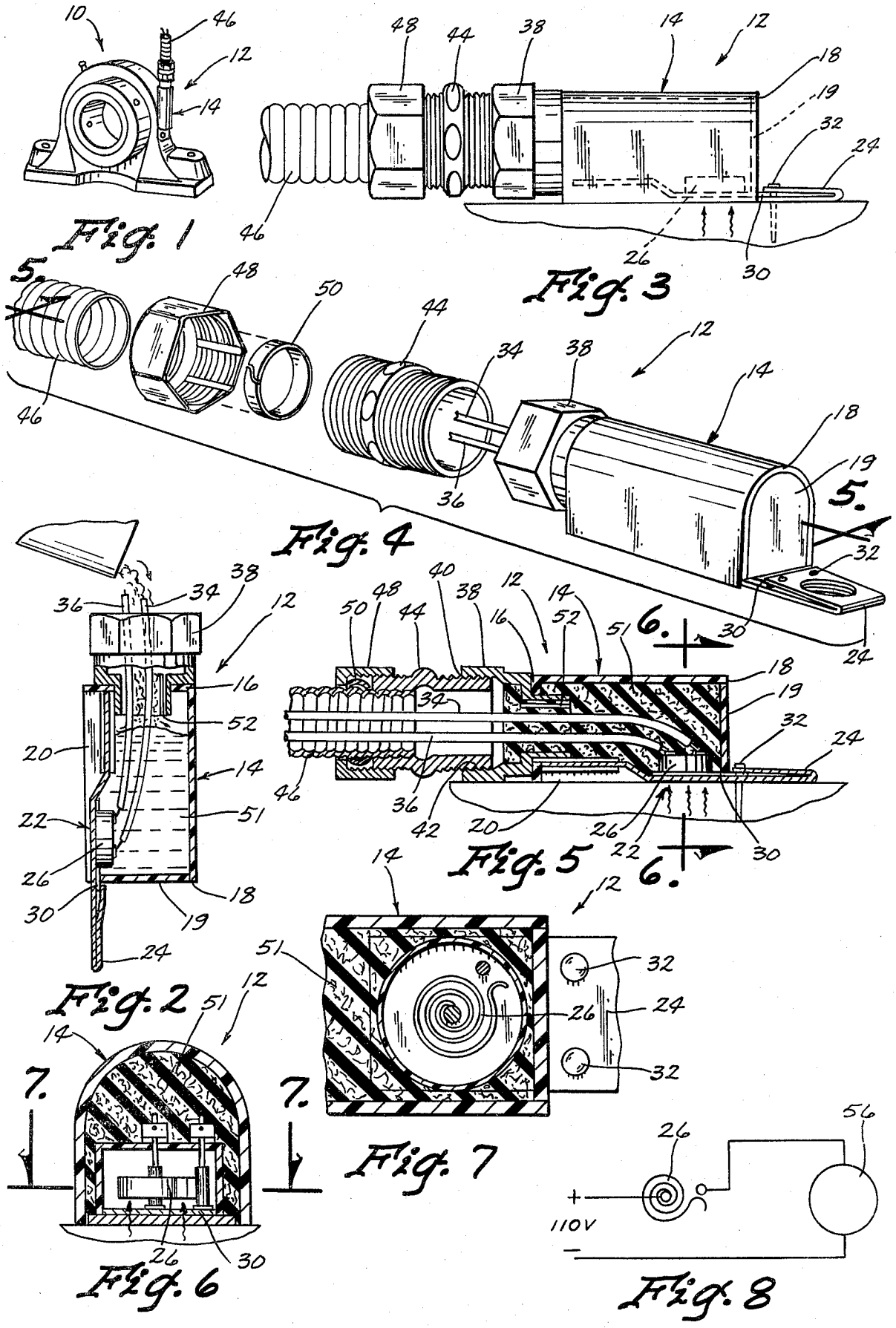

A nut is secured to one end of a flexible hollow conduit to provide a means for securing the conduit to one end of an externally threaded nipple. The other end of the nipple is threadably received by a bushing which is secured to and extends from one end of a hollow cartridge. A heat conductive plate means closes the open bottom end of the cartridge and is adapted to be secured to the member requiring heat monitoring. A heat detector switch is mounted on the plate means within the cartridge and has a pair of electrical wire secured thereto and extending therefrom through the cartridge, bushing, nipple and into the flexible conduit. The interior of the cartridge and at least a portion of the bushing are filled with a protective material such as epoxy or the like. The electrical wire are connected to a signal device which will be activated when the heat detector switch detects a predetermined temperature.

DESCRIPTION OF THE PREFERRED EMBODIMENT

Referring now to the drawings, the numeral 10 refers generally to a member requiring heat monitoring such as the pillow bearing illustrated therein. It should be understood that the apparatus of this invention may be mounted on any member requiring heat monitoring such as bearings, motors, etc. The numeral 12 refers generally to the heat sensing apparatus of this invention which is adapted to be mounted on the member 10 as will be described in more detail hereinafter.

Apparatus 12 includes a hollow cartridge 14 preferably comprised of nylon or the like and having an open end 16, open end 18 and an open bottom 20 which is closed by a heat conductive plate means 22. The lower opposite sidewalls of the cartridge 14 are provided with grooves or slits to permit the attachment of the plate means 22 thereto. Plate means 22 includes a U-shaped portion 24 which extends outwardly from the end 18 of cartridge 14.

The numeral 26 refers to a heat detector switch including a plate 30 which extends outwardly beneath the end 18 which is received by the U-shaped portion 24. The outer end of the plate 30 is provided with a pair of holes or openings which are adapted to register with openings formed in the U-shaped portion 24 so that nails 32 may be extended therethrough into the member 10. Nails 32 not only secure the apparatus to the member 10 but also serve to maintain the switch 24 in intimate contact with the plate means 22.

A pair of electrical wires 34 and 36 are secured to the heat detector switch 26 and extend therefrom. Bushing 38 includes an end portion 40 which is received by the open end 16 of cartridge 14 and which is secured thereto by any convenient means. Bushing 38 includes an internally threaded portion 42 which threadably receives one end of a male nipple 44. The numeral 46 refers to a flexible hollow conduit which is preferably plastic covered. A typical type of flexible conduit is marketed under the trademark "LIQUI-TITE". Nut 48 is mounted on the flexible conduit 46 and secured thereto by means of split ring 50 so that a rigid and positive connection is provided therebetween. Nut 48 is threadably mounted on the nipple 44 as illustrated in the drawing. The interior of the cartridge 14 and at least a portion of the bushing 38 are filled with a protective sealing means such as conventional pourable epoxy 51. The end portion 40 of bushing 38 is provided with a pair of slits 52 extending between the ends thereof for a purpose to be described hereinafter.

The normal method of assembling the apparatus is as follows. Heat detector switch 26 is positioned on plate 22 before the plate 22 is secured to the cartridge 14. The end of plate 30 is received by the U-shaped portion 24 so that the openings in the plate 30 align with the openings in the plate means 22. The electrical wires 34 and 36 would then be secured to the switch 26 if this had not been previously done. Plate 22 is then secured to the cartridge 14 so as to close the lower end of the same. The end member 19 is then inserted into end 18 of the cartridge 14 and maintained therein by suitable glue, adhesive, etc. The unit is then moved to the vertical position as illustrated in FIG. 2 with the epoxy material being poured into the interior thereof through the bushing 38. The epoxy material is poured into the unit until cartridge 14 is completely full and so that a portion of the bushing is also filled with the epoxy material. The epoxy material surrounds the heat detector switch 26 and seals the interior of the unit. The air escape slits 52 permit air to escape from the interior of the unit as the epoxy material is being poured thereinto.

The epoxy material is allowed to harden for approximately eight hours while the unit is maintained in the position illustrated in FIG. 2. The apparatus may then be secured to the member 10 by means of the nails 32. The U-shaped portion 24 is provided with an opening 54 to permit a grease zerk to extend therethrough if necessary. Nipple 44 is then threadably mounted in the bushing 38 and the conduit 46 and nut 48 are secured to the nipple 44. The attachment of the flexible conduit 46 to the bushing 38 by the nipple 44 achieves a dust proof connection which is also rodent proof. The apparatus is extremely durable and protects the heat detector switch 26. The electrical wires are operatively connected to a signal device such as an alarm 56. If the member 10 becomes heated to a predetermined temperature, switch 26 closes the circuit to the alarm 56 to activate the same thereby indicating that dangerous temperature conditions have been reached in the member 10.

Thus it can be seen that an improved heat sensing apparatus has been provided which not only senses the temperature of a member requiring heat monitoring but which also provides a dust proof and rodent proof connection between the apparatus and the flexible conduit. The fact that the wires 34 and 36 extend through the conduit 46 prevents rodents or the like from chewing on the same. The epoxy material in the apparatus not only prevents dust from entering the interior of the unit but provides a sealing and cushioning means for the heat detector switch 26. Thus it can be seen that the apparatus accomplishes at least all of its stated objectives.

I claim:

1. In combination with a member requiring heat monitoring, comprising, a hollow cartridge having first and second ends and an open bottom portion, a heat conductive plate means secured to said cartridge and closing said open bottom portion, said plate means extending outwardly beyond the said first end of said cartridge, a heat sensing means mounted on said plate means in said cartridge, a first bushing including first and second ends, secured to said cartridge and having one end received by said second end of said cartridge, said first bushing having an internally threaded portion at its said second end, a flexible hollow conduit operatively secured to said internally threaded second end of said first bushing, an electrical wire means extending through said flexible conduit, first bushing and said cartridge and being electrically connected to said heat sensing means, protective sealing means filling said cartridge and at least a portion of said first bushing, said sealing means also extending over and around said heat sensing means, means operatively mounting said plate means to the member requiring heat monitoring, said electrical wire means adapted to be operatively connected to a signal means which is activated by said heat sensing means when the member requiring heat monitoring reaches a predetermined temperature which is transmitted through said plate means to said heat sensing means.

2. The combination of claim 1 wherein an externally threaded male nipple has one end thereof threadably received by said second end of said first bushing, a nut means secured to and mounted on said flexible conduit, said nut means being threadably mounted on the other end of said male nipple to secure said flexible conduit to said first bushing in a sealed relationship.

3. The combination of claim 1 wherein said first bushing has at least one air escape slit formed therein to permit air to escape from said cartridge and said first bushing during the positioning of said protective sealing means therein.

* * * * *